US010493652B2

(12) United States Patent
Hanses

(10) Patent No.: US 10,493,652 B2
(45) Date of Patent: Dec. 3, 2019

(54) VENEER PEELING APPARATUS

(71) Applicant: HANSES SÄGEWERKSTECHNIK GMBH & CO. KG, Meschede-Remblinghausen (DE)

(72) Inventor: Josef Hanses, Meschede-Remblinghausen (DE)

(73) Assignee: Hanses Sägewerkstechnik GmbH & Co. KG, Meschede-Remblinghausen (DE)

( * ) Notice: Subject to any disclaimer, the term of this patent is extended or adjusted under 35 U.S.C. 154(b) by 219 days.

(21) Appl. No.: 15/574,286

(22) PCT Filed: May 9, 2016

(86) PCT No.: PCT/EP2016/060301
§ 371 (c)(1),
(2) Date: Nov. 15, 2017

(87) PCT Pub. No.: WO2016/184710
PCT Pub. Date: Nov. 24, 2016

(65) Prior Publication Data

US 2018/0133921 A1 May 17, 2018

(30) Foreign Application Priority Data

May 16, 2015 (DE) ..... 20 2015 102 518 U

(51) Int. Cl.
*B27L 5/02* (2006.01)
*B27D 1/10* (2006.01)

(52) U.S. Cl.
CPC . *B27L 5/02* (2013.01); *B27D 1/10* (2013.01)

(58) Field of Classification Search
CPC ..... B27L 5/02; B27L 5/06; B27L 5/08; B27L 5/006; B27D 1/10
See application file for complete search history.

(56) References Cited

U.S. PATENT DOCUMENTS

| | | | | |
|---|---|---|---|---|
| 306,643 | A | 10/1884 | Ranger | |
| 340,745 | A | 4/1886 | Waterman et al. | |
| 567,153 | A | 9/1896 | Morrison et al. | |
| 796,176 | A | 8/1905 | Bartholomew | |
| 2,571,603 | A | 10/1951 | Payzant | |
| 3,147,782 | A | 9/1964 | Pearl | |
| 4,289,179 | A | 9/1981 | Koba | |
| 4,930,556 | A * | 6/1990 | Prihoda | B27D 1/00 144/209.1 |
| 5,360,042 | A | 11/1994 | Teh | |
| 2008/0092989 | A1 * | 4/2008 | Heiner | B27L 5/022 144/363 |

(Continued)

FOREIGN PATENT DOCUMENTS

| | | | |
|---|---|---|---|
| DE | 869690 | B | 3/1953 |
| DE | 887702 | B | 8/1953 |

(Continued)

*Primary Examiner* — Matthew Katcoff
(74) *Attorney, Agent, or Firm* — Richard M. Goldberg

(57) ABSTRACT

A veneer peeling apparatus includes a bearing frame (10) for rotatably supporting a round wood (20), a peeling blade (24) which can be placed against the periphery of the round wood, and at least one milling head (40) for scarfing at least one edge of the veneer, wherein the milling head (40) includes a groove milling cutter (44) for trimming the veneer.

9 Claims, 5 Drawing Sheets

(56) References Cited

U.S. PATENT DOCUMENTS

2012/0325371 A1* 12/2012 Koike ..... B27D 1/04
144/363

FOREIGN PATENT DOCUMENTS

| | | | |
|---|---|---|---|
| DE | 2234475 | A | 1/1973 |
| DE | 2719416 | A1 | 11/1978 |
| DE | 3614126 | A1 | 10/1986 |
| DE | 69938072 | T2 | 1/2009 |
| GB | 699569 | A | 11/1953 |

* cited by examiner

VENEER PEELING APPARATUS

BACKGROUND OF THE INVENTION

The invention relates to a veneer peeling apparatus comprising a bearing frame for rotatably supporting a round wood, a peeling blade which can be placed against the periphery of the round wood, and at least one milling head for scarfing at least one edge of the veneer.

For forming the veneer, the round wood is driven for rotation about its longitudinal axis in the bearing frame, and a web of veneer is continuously peeled off from the periphery of the round wood. Since the radius of the round wood decreases in this process, the peeling blade is adjusted in radial direction.

The peeled veneers produced in this way are used for example for forming veneer laminates. To that end, the web of veneer is divided, after peeling, into separate panels which are then dried, coated with an adhesive and are laminated one upon the other in the configuration of a so-called "book" and are glued together. The book is an endless string of several layers of the veneer panels wherein the butting joints between the individual panels are offset from one another from layer to layer. When the book is laid, the veneer panels are arranged such that the panels that belong to the same layer overlap one another in an edge zone, so that a good bond can be achieved. However, in order to prevent the material from becoming thicker in the edge zones than in the remaining areas, the panels are scarfed in the edge zones, i.e. they are cut or milled so as to acquire a wedge-shaped cross-section, so that their thickness decreases in the edge zone and linearly approaches zero towards the edge.

In the methods that are commonly employed, the panels are scarfed only after they have been dried. However, the dried veneer is relatively hard and is therefore difficult to machine. In particular, in case of relatively hard wood such as beech, the scarfing frequently results in irregularities and breakage of the material so that the trim of the veneer becomes irregular and frayed.

DE 887 702 discloses a veneer peeling apparatus of the type described above, wherein a milling head for scarfing the veneer is integrated, so that so-called wet scarfing may be performed prior to, during, or directly after the peeling process and in any case before the veneer is dried.

SUMMARY OF THE INVENTION

It is an object of the invention to provide a veneer peeling apparatus which permits a facilitated and more precise further processing of the veneer.

According to the invention, in order to achieve this object, the milling head has a groove milling cutter for trimming the veneer.

In this apparatus, the veneer is not only scarfed by means of the milling head, but it is also trimmed, that is, instead of allowing the thickness of the veneer to decrease to zero towards the edge, a seam at the outmost edge of the veneer is cut away so as to obtain a smooth and neat butting edge the height of which is smaller than the thickness of the veneer but larger than zero. The groove formed with the groove milling cutter separates the seam from the main body of the veneer, so that one flank of the groove will form the butting edge.

Thus, in the apparatus according to the invention, the veneer obtains, at least on one side, a straight, hardly frayed and well defined edge which can precisely be detected with suitable sensors and can also serve as a reference edge for aligning the veneer. For example, this edge may be used for precisely aligning the veneer web in longitudinal direction, so that the web can be divided into separate panels by means of saw cuts which extend precisely at right angles to said edge. In this way, it is possible to obtain veneer panels with a perfect rectangular shape and with equal dimensions of all panels, whereby an electronic process control in the further processing steps is greatly facilitated.

In book laying, the veneer panels are oriented such that the scarfed edges, which initially, directly after peeling, have formed the longitudinal edges of the web, extend in transverse direction of the multi-layer string forming the book. Then, the scarfed and trimmed edges can be detected with high precision, whereby it becomes easier to control the book laying process such that zones of overlap can be obtained which have uniform widths and are precisely adapted to the scarf profile.

Useful details and further developments of the invention are indicated in the dependent claims.

The machining with the milling head may take place before or after the proper peeling process. If it takes place only after peeling, i.e. when the veneer web has already been separated from the round wood, it is necessary, however, to support the veneer web on some support rollers on the side opposite to the milling head. If machining is performed at the round wood, at a position upstream of the peeling blade as seen in circumferential direction, then the round wood itself can serve as a counter bearing for the milling head. The groove formed with the groove milling cutter does not yet separate the seam completely from the rest of the veneer, but the separation will be completed only in the peeling process. Preferably, the depth of the groove is larger than the thickness of the veneer, as determined by the position of the peeling blade, so that, during peeling, the seam will be separated completely from the rest of the veneer and will drop off.

The milling head is preferably arranged such that its axis is parallel with the longitudinal axis of the round wood. The exact milling depth can be controlled by determining the position of the milling head relative to the peripheral surface of the round wood by means of a follower roll which rolls on the peripheral surface of the round wood. For example, the follower roll and the milling head may be arranged on a common axis. Then, the follower roll has a diameter corresponding to the smallest diameter of the conical section of the milling head with which the scarf is produced.

The milling head and the follower roll may be biased elastically against the round wood, so that they will automatically adapt to the gradually decreasing radius of the round wood.

In a useful embodiment, the milling head is provided on a pressure roll unit which has rotatably supported pressure rolls pressing against the round wood on the side opposite to the peeling blade in order to absorb a part of the reaction forces that occur in the peeling process. In principle, these pressure rolls may also take over the function of the follower roll. However, if the round wood is peeled down to a very small radius in order to exploit the material as far as possible, then the cross-section of the round wood may become so small that the wood will bend under the force of the peeling blade and will therefore urge the pressure rolls further away from the axis of the bearing frame. In order to assure that the milling head is not affected by this change in position but always retains its correct position relative to the peripheral surface at the end of the round wood, it is preferred that the milling head itself is elastically supported on the pressure roll unit.

BRIEF DESCRIPTION OF THE DRAWINGS

An embodiment example will now be described in conjunction with the drawings, wherein.

DETAILED DESCRIPTION

Figure 1:
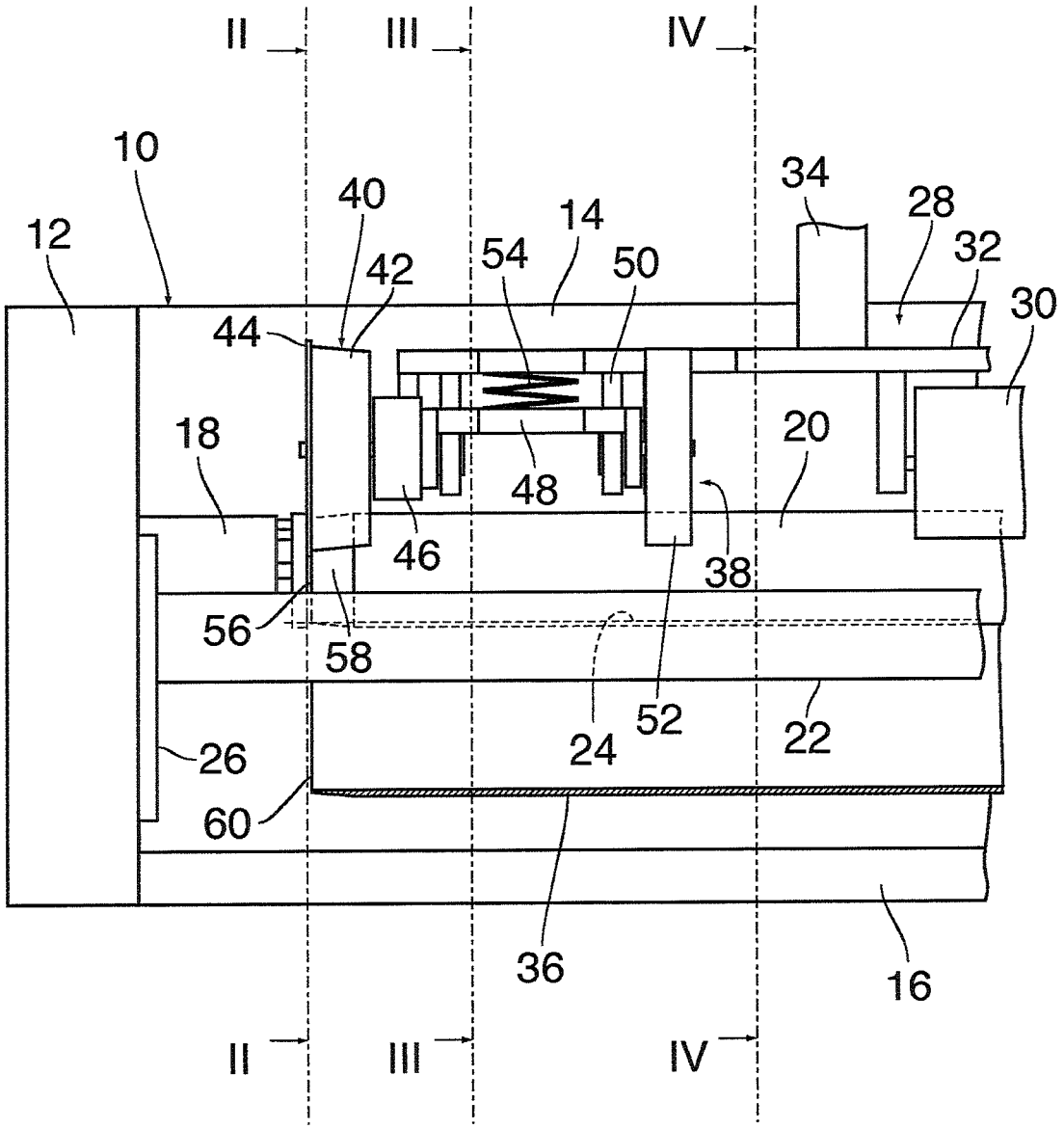
FIG. 1 is a schematic view of an end of a veneer peeling apparatus as seen from a direction in which the peeled veneer is withdrawn.

FIG. 1 schematically shows an end of a veneer peeling apparatus having a bearing frame 10 of which a side wall 12, a rear wall 14 and a base 16 are visible in the drawing. Mandrels 18, which serve for mounting a round wood 20 such as a tree trunk that has been barked and cut to length, are rotatably supported in the side wall 12 and, correspondingly, in an opposite side wall which is not shown here.

A cutting beam 22 extends in parallel with the round wood 20 and has a cutting blade 24 which, in FIG. 1, is invisibly disposed on the back side of the cutting beam 22 and of which only the cutting edge has been indicated in dashed lines. The opposite ends of the cutting beam are held in the bearing frame 10 by guides 26 so as to be adjustable in vertical direction.

Above the round wood 20, there is provided a pressure roll unit 28 which rotatably support two sets of pressure rolls 30. The pressure rolls 30 are arranged on a bottom side of a support 32 which is suspended from a drive mechanism (not shown) with support arms 34 and is movable in vertical direction relative to the bearing frame 10. By means of the drive mechanism, the pressure roll unit 28 is pressed against the round wood 20 such that the pressure rolls 30 roll over the periphery of the round wood and bear a part of the reaction forces that the cutting blade 24 exerts upon the round wood.

By means of a drive mechanism, which has not been shown and which acts upon the mandrels 18 and/or the pressure rolls 30, the round wood 20 is rotated about its longitudinal axis, while the cutting blade 24 is set with its cutting edge against the peripheral surface of the round wood such that an endless web 36 of veneer is peeled off from the round wood. The web 36 is withdrawn above the base 16 of the bearing frame in a direction towards the viewer in FIG. 1, so that the web of veneer is seen in cross-section.

While the pressure rolls 30 are disposed at a certain spacing from the side walls of the bearing frame and from the ends of the round wood 20, the support 32 is extended towards the side wall 12 beyond the pressure rolls and carries, in this extended part, a milling head unit 38 with a milling head 40 that can be driven for rotation. The milling head has a conical scarfing tool 42 the diameter of which increases towards the side wall 12. More precisely, the scarfing tool is formed by blades that have not been shown here and have cutting edges disposed in a common conical surface enveloping the tool. A radially projecting groove milling cutter 44 is disposed adjacent to the outer end of the scarfing tool 42, i.e. the end having the largest diameter.

The milling head 40 and an associated drive 46 are mounted on a free end of a rocker 48 the opposite end of which, facing away from the viewer in FIG. 1, is rotatably supported on bearing blocks 50 that project from the bottom side of the support 32. The rocker 48 is fork-shaped and carries, on the side opposite to the milling head 40, a rotatable follower roll 52 having an axis collinear with the axis of rotation of the milling head 40. The outer diameter of the follower roll 52 is equal to the smallest diameter of the conical scarfing tool 42.

Above the rocker 48, the support 32 forms a tongue that projects in parallel with the rocker, and a compression spring 54 is arranged between the free end of this tongue and the free and of the rocker 48 for biasing the milling head unit 38 downwards and holding the follower roll 52 and the milling head 40 in engagement with the peripheral surface of the round wood 20.

The groove milling cutter 44 cuts a groove 56 in a position slightly offset from the end of the round wood 20, and, adjacent to an inside edge of this groove, there is a conical scarfing zone 58 which is formed by means of the scarfing tool 42 and fades out in the peripheral surface of the round wood.

When a peripheral region of the round wood 20 that has been machined with the milling head 40 in this way reaches the cutting blade 24, an outer peripheral layer is peeled off and forms the veneer web 36. The thickness of the veneer is smaller than the depth of the groove 56 so that, during peeling, a fringe on the side beyond the groove 56 is separated from the web. In this way, the main part of the veneer web 36 obtains a butting edge 60 that is formed by one of the two flanks of the previously formed groove 56. In a direction away from this butting edge, the thickness of the veneer in the scarfing zone 58 increases linearly until it finally reaches the full thickness of the veneer.

Figure 2:
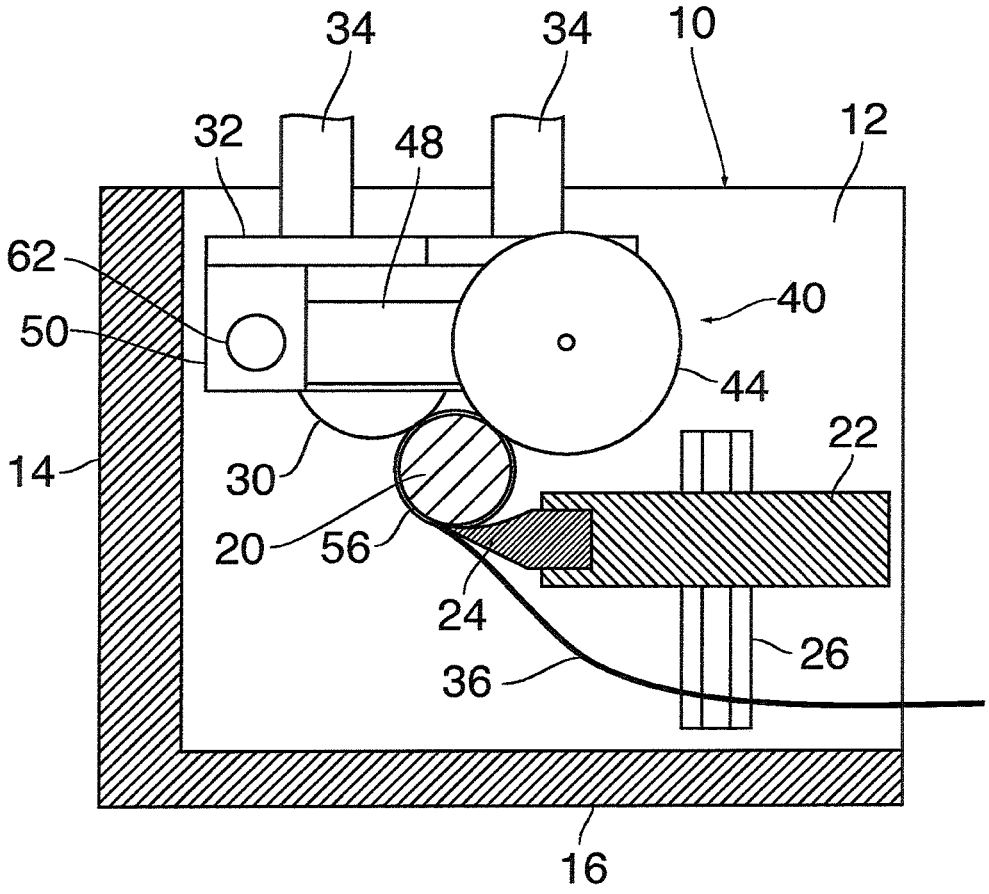
FIG. 2 is a sectional view along the line II-II in FIG. 1.

In FIG. 2, the cutting blade 24 has been shown in cross-section. The sectional plane in this drawing corresponds to the position of the groove 56, so that an end face of the milling head 40, which end face is formed by the groove milling cutter 44, faces the viewer. Both the round wood 20 and the milling head 40 rotate in counter-clock sense in FIG. 2. A bearing 62 which rotatably supports an end of the rocker 48 on the bearing blocks 50 is also visible in this drawing.

Figure 3:
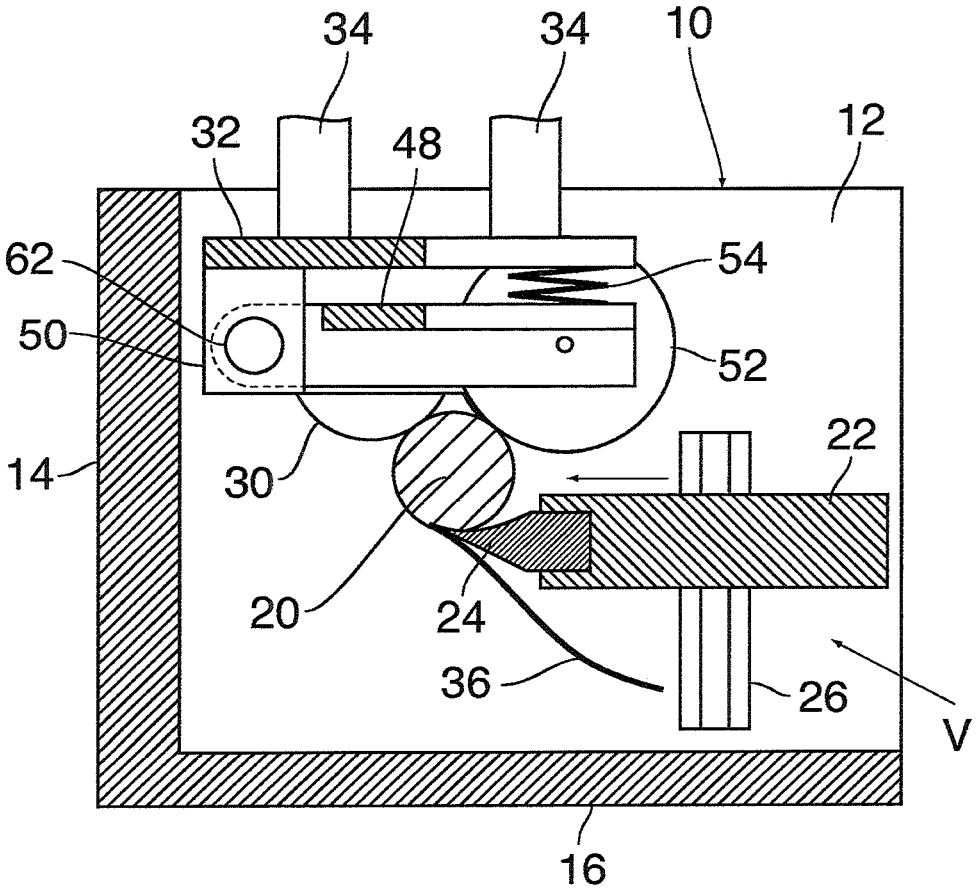
FIG. 3 is a sectional view along the line III-III in FIG. 1.

In FIG. 3, the sectional plane corresponds to the position of the rocker 48, and this drawing shows the arm of the rocker that carries the follower roll 52. Further, the arrangement of the spring 54 relative to the bearing 62 can be seen. The spring 54 is a helical compression spring which, when compressed, exerts a torque on the rocker 48, so that the follower roll 52 and the milling head are pressed against the round wood 20.

Figure 4:
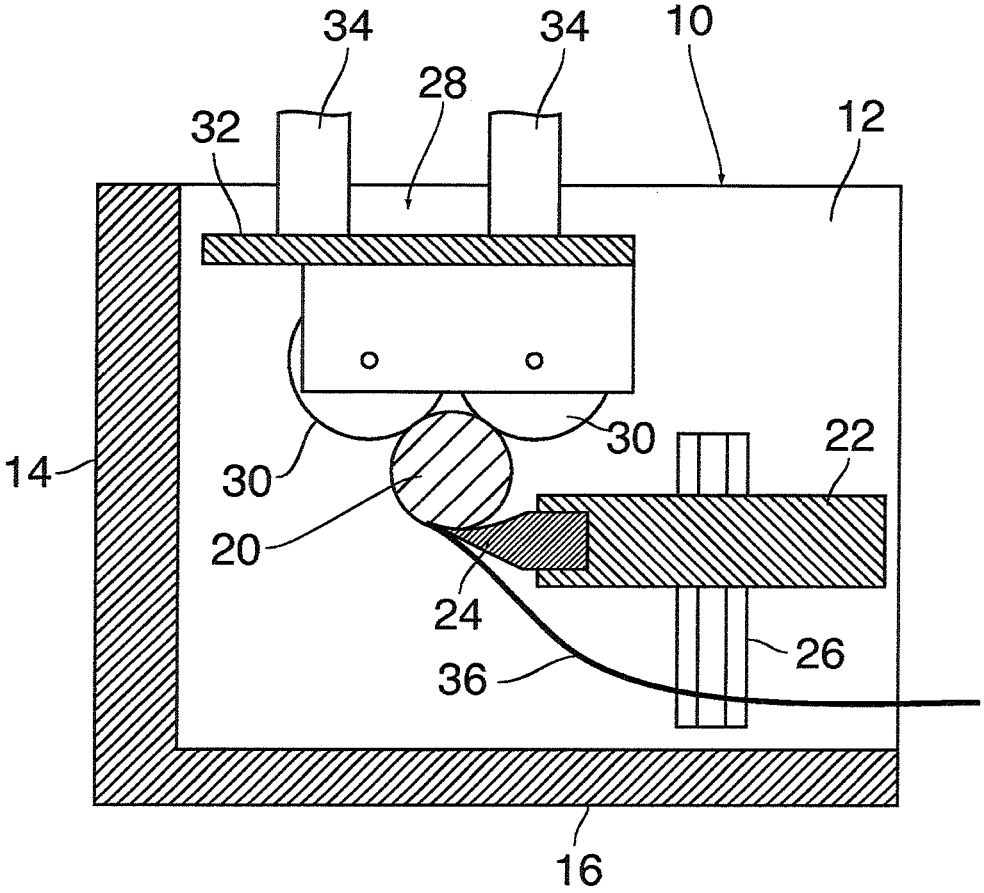
FIG. 4 is a sectional view along the line IV-IV in FIG. 1.

FIG. 4 shows the arrangement of the pressure rolls 30 of the pressure roll unit 28 on both sides of the upper vertex of the round wood 20. In the amount in which the radius of the round wood 20 decreases as the peeling of the web 36 proceeds, the peeling blade 24 must be moved upwards, whereas the pressure roll unit 28 moves downward by the same amount in order for the pressure rolls 30 to stay in engagement with the peripheral surface of the round wood 20. This also maintains the correct positioning of the milling head unit 38 relative to the round wood 20.

In a preferred embodiment, two milling head units 38 are disposed symmetrically at opposite ends of the support 32, and both units are commonly adjusted together with the pressure roll unit 28 in accordance with the decreasing radius of the round wood.

However, when the diameter of the round wood 20 has decreased to a very small value, it is possible that the force exerted by the pressure rolls 30 is no longer sufficient for counterbalancing the force of the cutting blade 24, so that the round wood is bent upwards in the central portion. Since, then, the pressure roll unit 28 yield upwards whereas the ends of the round wood are still held in position in the mandrels 18, the distance between the milling head 40 and the periphery of the round wood become larger. This effect is compensated, however, by the springs 54 which hold the milling head units in engagement with the respective ends of the round wood.

Figure 5:
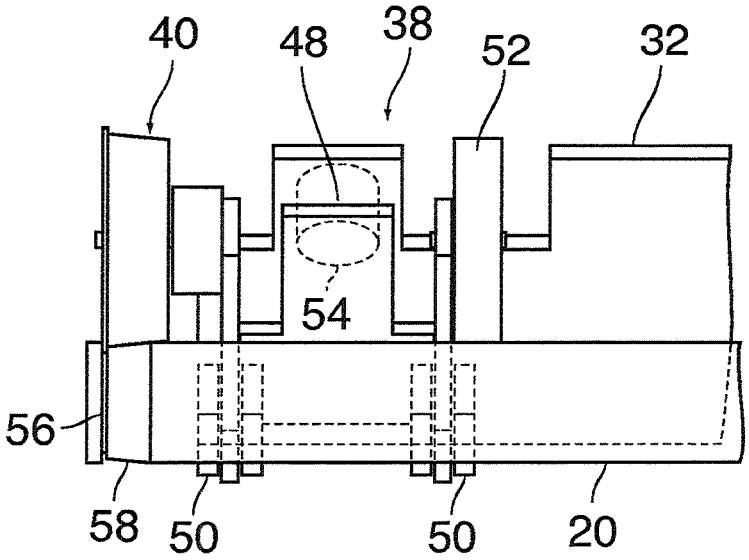
FIG. 5 is a view of parts of the apparatus as seen in the direction indicated by an arrow V in FIG. 3.

In FIG. 5, the round wood 20 and the milling head unit 38 have been shown in a view in which the direction of view is tangential to the point where the milling head 40 and the follower roll 52 contact the periphery of the round wood. Here, it can be seen more clearly how the milling head generates the profile of the groove 56 and the scarfing zone 58.

Figure 6:
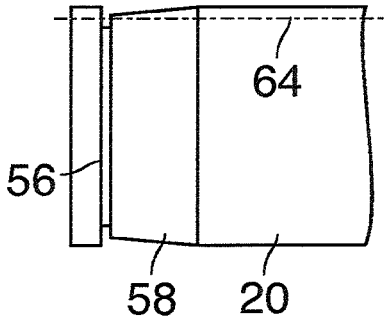
FIG. 6 is an enlarged view of an end of a round wood directly before the step of peeling off a veneer.
Figure 7:
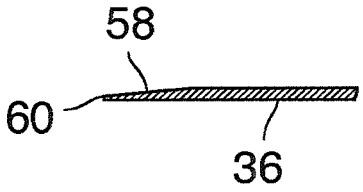
FIG. 7 is a sectional view of an edge of the peeled veneer.

In FIG. 6, the end of the round wood 20 that has been machined with the milling head has been shown on a larger scale. A dash-dotted line 64 indicates the radial position of the cutting blade and, correspondingly, the thickness of the peeled web 36 which has been shown separately in FIG. 7.

Figure 8:
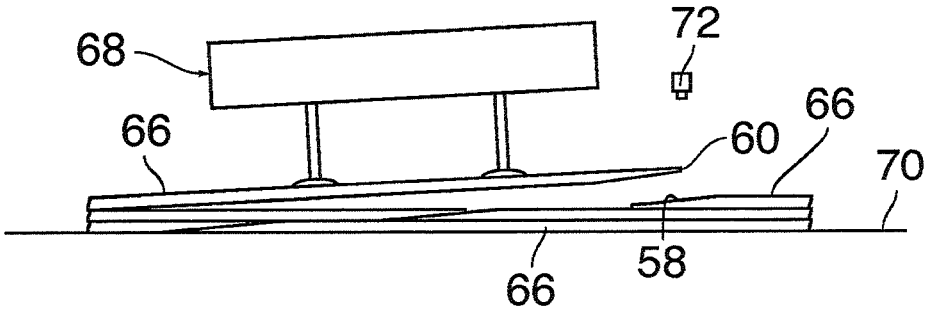
FIG. 8 is a sketch illustrating a book laying operation.

FIG. 8 is a sketch illustrating a book laying operation in which veneer panels 66 that have been obtained by dividing the veneer web 36 are disposed on a conveyer 70 in several layers by means of a stacker 68. The panels 66 form an endless string that extends in longitudinal direction of the conveyer 70. However, the panels are oriented such that their scarfed edges extend in transverse direction of the conveyer, i.e. normal to the plane of the drawing in FIG. 8. The panels that belong to the same layer are laid such that their edges overlap with their scarfing zones 58, so that the thicknesses of the overlapping panels add up to the total thickness of the veneer at any point (with the exception of negligible small "gaps" at the butting edges 60). The butting joints between the veneer panels 66 of the several layers are offset from one another in the transport direction of the conveyer 70. Since the milling heads 40 provided at the opposite ends of the bearing frame 10 are both arranged on the same side (outward side) of the peeled veneer web, the scarfing zones at the opposite edges of the panels 66 in FIG. 8 would, strictly speaking, not be complementary one another, but one would be the mirror image of the other. However, since the veneer is thin and flexible, the scarfing zones are bent downwards when a next higher layer is superposed, so that they flatly engage the surface of the next lower layer on the conveyer 70, respectively, and assume a shape that is complementary to the scarfing zone of the panel that has been superposed.

Since, in the peeling process described above, the panels 66 have been trimmed so as to provide a smooth and straight butting edge 60, this edge can be recognized precisely, e.g. by means of an optical sensor 72. This permits an electronic control of the stacker 68 such that each panel is laid in the correct position.

What is claimed is:

1. A veneer peeling apparatus comprising:

a bearing frame for rotatably supporting a round wood, a peeling blade adapted to be placed against a periphery of the round wood for peeling a veneer from the round wood, and at least one milling head for scarfing at least one edge of the veneer, wherein the at least one milling head comprises a groove milling cutter for trimming the veneer.

2. The apparatus according to claim 1, comprising a milling head unit on which the at least one milling head and a follower roll are arranged such that the follower roll engages the periphery of the round wood and holds the at least one milling head in a working position thereof.

3. The apparatus according to claim 1, further comprising a drive for driving the at least one milling head for a rotation about an axis that is parallel to an axis of the round wood.

4. The apparatus according to claim 1, wherein the at least one milling head is arranged at the periphery of the round wood rotating in the bearing frame in such a position that the at least one milling head attacks the round wood in a position upstream of the peeling blade as seen in a rotary direction of the round wood.

5. The apparatus according to claim 4, wherein the groove milling cutter is configured so as to create a groove in the round wood deeper than a thickness of a web of the veneer to be peeled-off later.

6. The apparatus according to claim 4, wherein the at least one milling head is elastically biased against a peripheral surface of the round wood.

7. The apparatus according to claim 4, further comprising a pressure roll unit having pressure rolls which engage the periphery of the round wood on a side opposite to the peeling blade, and wherein the at least one milling head is provided on the pressure roll unit.

8. The apparatus according to claim 7, wherein the pressure roll unit is resiliently biased against the round wood, wherein the pressure roll unit includes a support, wherein the at least one milling head is elastically supported on the support of the pressure roll unit, and further comprising a spring for biasing the at least one milling head against the round wood.

9. The apparatus according to claim 8, further comprising a rocker having a base end that is rotatably held on the support, and wherein the at least one milling head is provided on a free end of the rocker.

* * * * *